US008584435B2

(12) United States Patent
Pinchen

(10) Patent No.: US 8,584,435 B2
(45) Date of Patent: Nov. 19, 2013

(54) ANTI-COUNTERFEIT MEASURES

(75) Inventor: Stephen Pinchen, Hudson, MA (US)

(73) Assignee: Filtrona United Kingdom Ltd., Nottingham (GB)

( * ) Notice: Subject to any disclaimer, the term of this patent is extended or adjusted under 35 U.S.C. 154(b) by 29 days.

(21) Appl. No.: 12/475,046

(22) Filed: May 29, 2009

(65) Prior Publication Data

US 2009/0235615 A1 Sep. 24, 2009

Related U.S. Application Data

(62) Division of application No. 12/119,929, filed on May 13, 2008, which is a division of application No. 10/492,240, filed as application No. PCT/GB02/04536 on Oct. 7, 2002, now abandoned.

(30) Foreign Application Priority Data

Oct. 9, 2001 (GB) ..... 0124254.4

(51) Int. Cl.
*B65B 61/26* (2006.01)

(52) U.S. Cl.
USPC ..... 53/410; 53/449; 53/133.5; 53/411; 53/170; 53/131.2

(58) Field of Classification Search
USPC ..... 53/507–508, 396–397, 449, 410–411, 53/170, 128.1, 131.2, 133.5, 133.3
See application file for complete search history.

(56) References Cited

U.S. PATENT DOCUMENTS

| | | | | |
|---|---|---|---|---|
| 3,969,830 | A * | 7/1976 | Grasham | 380/54 |
| 4,433,437 | A * | 2/1984 | Fantone | 382/210 |
| 4,511,616 | A * | 4/1985 | Pitts et al. | 428/203 |
| 4,668,597 | A | 5/1987 | Merchant | 430/22 |
| 4,807,745 | A * | 2/1989 | Langley et al. | 206/245 |
| 5,142,384 | A * | 8/1992 | Wood et al. | 359/3 |
| 5,222,642 | A * | 6/1993 | Solarz | 224/191 |
| 5,223,357 | A * | 6/1993 | Lovison | 430/1 |
| 5,280,385 | A * | 1/1994 | Wybrow | 359/438 |

(Continued)

FOREIGN PATENT DOCUMENTS

| | | | |
|---|---|---|---|
| EP | 0 585 076 A2 | 3/1994 | C09J 7/02 |
| EP | 0 765 818 A1 | 4/1997 | B65D 75/68 |

(Continued)

OTHER PUBLICATIONS

Office Action issued Jan. 4, 2013 in U.S. Appl. No. 12/119,929.

*Primary Examiner* — Christopher Harmon
(74) *Attorney, Agent, or Firm* — Banner & Witcoff Ltd.

(57) ABSTRACT

A conventional cigarette packet in a transparent film of biaxially oriented polypropylene (BOPP) with a tear tape for removing the film adhered to the inside of the film. The tear tape bears an indicium which is either hidden or which changes according to the viewing angle when the image is viewed through the film. The image on the tear tape may be scrambled or coded. The overwrap film includes a descrambling or decoding region which reveals the hidden image or renders the image visible when viewed through the overwrap portion, or creates the visual effect of changing the image according to the viewing angle. The descrambling or decoding region typically comprises a diffraction structure, such as a grating, the characteristics of which, such as its pitch, are complementary with the scrambled or coded image and/or with the pitch of any grid or matrix from which the image is composed.

3 Claims, 2 Drawing Sheets

(56) References Cited

U.S. PATENT DOCUMENTS

Figure 1:
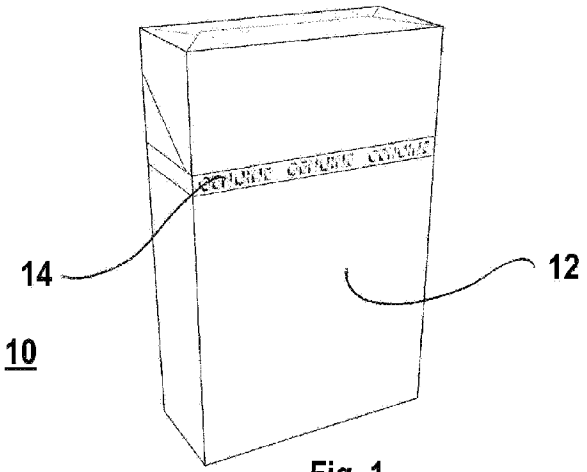

| | | | | |
|---|---|---|---|---|
| 5,282,066 | A * | 1/1994 | Yu et al. | 359/3 |
| 5,319,475 | A * | 6/1994 | Kay et al. | 359/2 |
| 5,342,672 | A * | 8/1994 | Killey | 428/32.64 |
| 5,524,758 | A | 6/1996 | Lupul | 206/459.5 |
| 5,647,151 | A * | 7/1997 | Fantone et al. | 40/454 |
| 5,712,731 | A | 1/1998 | Drinkwater et al. | 359/619 |
| 5,769,227 | A * | 6/1998 | Fantone | 206/459.1 |
| 5,999,280 | A | 12/1999 | Huang | 359/2 |
| 6,026,385 | A * | 2/2000 | Harvey et al. | 705/408 |
| 6,062,604 | A | 5/2000 | Taylor et al. | 283/72 |
| 6,070,724 | A * | 6/2000 | McCool | 206/352 |
| 6,435,502 | B2 * | 8/2002 | Matos | 273/157 R |
| 6,793,755 | B2 * | 9/2004 | Schaupp et al. | 156/215 |
| 6,923,444 | B2 * | 8/2005 | Matos | 273/153 S |
| 7,159,866 | B2 * | 1/2007 | Selph | 273/157 R |
| 2001/0000741 | A1 | 5/2001 | Pinchen et al. | 428/343 |
| 2002/0185212 | A1 * | 12/2002 | Schaupp et al. | 156/205 |
| 2003/0121984 | A1 * | 7/2003 | Pinchen et al. | 235/487 |
| 2005/0019680 | A1 | 1/2005 | Pinchen | 430/10 |
| 2005/0024477 | A1 | 2/2005 | Noguchi et al. | |

FOREIGN PATENT DOCUMENTS

| | | | | |
|---|---|---|---|---|
| EP | 1 132 786 | A2 | 9/2001 | G03H 1/02 |
| EP | 0 585 076 | B1 | 11/2001 | C09J 7/02 |
| EP | 0 765 818 | B1 | 11/2004 | B65D 75/68 |
| WO | WO 02/22464 | A1 | 3/2002 | B65D 75/66 |

* cited by examiner

ANTI-COUNTERFEIT MEASURES

This application is a divisional application from U.S. application Ser. No. 12/119,929 which was filed on May 13, 2008, which in turn is a divisional application from U.S. application Ser. No. 10/492,240 (US Pub. No. 2005/0019680 A1), which was filed as a 35 U.S.C. 371 application from international application no. PCT/GB02/04536 having an international filing date of Oct. 17, 2002 (WO2003/32262 A3), the contents of each which are incorporated by herein reference in their entirety.

The present invention relates to anti-counterfeit measures for articles, and is concerned particularly with packaging which is difficult to copy, and which therefore is difficult for would-be counterfeiters to reproduce.

The counterfeiting of consumer goods, and especially cigarettes, perfumes, pharmaceutical products, CDs and DVDs may currently account for as much as an estimated 5 to 7% of world trade in such products. This represents significant losses both for brand owners and (where duty is payable on legitimate goods) for governments. In order to mislead a consumer into believing that a genuine product is being purchased, the packaging of the fake product is made to resemble closely that of the genuine product, or even to reproduce it exactly.

One widely used packaging technique involves overwrapping an article with transparent film and providing a tear tape which may be pulled through the overwrap film to release the article. An advantage of using the combination of tear tape and overwrap film is that this can provide evidence of tampering, whilst still displaying the article to the consumer before the article is purchased. The tape and/or overwrap film may bear a logo, promotional message or other visible indicium.

In an effort to reduce counterfeiting, manufacturers may include both overt and covert indicia on their products and/or on the packaging.

Covert indicia, i.e. markings which are not visible to the naked or untrained eye, and which may for example require a lens or lamp for them to be seen, are often difficult to copy. They may be checked by experts or officials to verify the authenticity of the product, but since they are not visible to the naked or untrained eye they are of little use in reassuring the would-be purchaser of the genuineness of the product.

On the other hand, overt devices such as intricate printed logos, whilst apparently providing reassurance to the consumer that the product is genuine (based upon a presumption that the logo must have been applied by the manufacturer) may, in fact, be relatively easy to copy using modern computerised techniques. Generally speaking, the more overt or visible the device the more readily it may be copied.

There is, therefore, a need for packaging which can include overt indicia that are difficult to reproduce.

According to a first aspect of the present invention there is provided an article containing a hidden image, printed onto a surface of the article, which image can only be detected when viewed through an optical device.

According to a second aspect of the present invention there is provided an article containing an image printed onto a surface of the article, wherein a change in the appearance of the image can only be detected when the article is viewed through an optical device.

The hidden image may be incorporated into a main image, which may comprise a plurality of image elements arranged in a grid or matrix. The hidden image which may comprise a plurality of image elements may be a portion of the main image or may be different to the main image and may be offset with respect to the matrix of the main image.

An optical device for viewing the hidden image may be provided on another article or, alternatively may be provided on the same article on which the hidden image is printed. When the optical device is placed in registration with the article on which the hidden image is printed, the hidden image becomes detectable.

In the case that the hidden image is provided on the same article as the optical device, the hidden image may be provided on the same surface, or an opposed surface of the article as the device, which may comprise a transparent substrate such as a film.

Where the hidden image is printed on one article and the optical device is provided on another article, the two articles may be arranged to lie permanently in registration by laminating, or otherwise joining them together such as by the use of adhesive.

One of the articles may be a tear tape for use in packaging and at least one article may be a portion of packaging.

Where the hidden image and optical device are provided on separate articles, the optical device may be brought into registration with the article bearing the image only when the image is to be viewed.

The optical device may comprise a grating or lens, which may be printed.

The hidden image may be scrambled or coded in that it may be divided into a plurality of image elements which may be arranged with respect to each other and/or with respect to the optical device, such that the hidden image is not visible unless viewed through a descrambling or decoding region of the optical device.

The descrambling or decoding region of the optical device may comprise a mark or template and/or may comprise optically variable elements and/or diffraction structures or louvres, which may be complementary to the image on the article bearing the hidden image, and which render the hidden image on the article visible when viewed through the descrambling or decoding region of the optical device when the two lie in registration.

In another aspect of the invention there is provided an article containing a printed image with complex characteristics, the appearance of which image changes depending on the angle from which the article is viewed.

The article may include an optical device, such as a lens or grating, superimposed on or integrated with the image, such that the image is viewed through or with the optical device. Preferably the optical device comprises a printed grating which is permanently superimposed onto the complex printed image and which provides for the image to change according to the angle from which it is viewed.

Changing of the image may include the appearance and/or disappearance of the image.

The article may comprise any article or portion of packaging material described herein, or any combination of such articles or portions.

A further aspect of the invention provides an article comprising first and second substrates, wherein each of the said substrates bears part of an image, such that the image is visible only when the two substrates are superimposed and in registration.

Preferably at least one of the substrates is substantially transparent and is arranged in use to be superimposed on, and in registration with, the other of said substrates.

In any aspect, the articles or substrates may for example comprise any combination within the following non-exhaustive list:

a label,
a tape, such as a tear tape,
a portion of filmic wrap,
a box or a carton,
threads,
identification documents,
passports.

For example the article or substrate bearing the hidden image or bearing part of the image may comprise a length of tear tape and the optical device or second substrate bearing the other part of the image may comprise a filmic overwrap, or vice-versa.

Alternatively, the article or substrate may comprise a label affixed either to a product or to a box or carton containing a product. The optical device or second substrate may comprise a portion of filmic overwrap, or may comprise a second label arranged to lie over the first label. In a further alternative example the article or substrate may comprise a label on a product or on a box or carton containing the product, and the optical device or second substrate may comprise a portion of tear tape.

The images may be visible in the visible part of the spectrum, or any other part of the electromagnetic spectrum, especially the ultra violet part of the spectrum, and references to viewing the image may include viewing by the human eye or viewing mechanically or electronically.

The invention also provides a method of packaging an article, the method comprising providing the article with first and second packaging portions, the first packaging portion bearing a hidden image which is visible only when viewed through the second packaging portion when the first and second packaging portions lie in registration, wherein the method includes superimposing the second packaging portion on the first packaging portion, so that the two packaging portions lie in registration.

The invention further provides a method of packaging an article, the method comprising providing the article with first and second packaging portions, each of which bears a part of an image, and superimposing the second packaging portion on the first packaging portion, so that the packaging portions lie in registration and the image becomes visible.

The invention also provides a method of printing a hidden image onto an article comprising at least one substrate, the method comprising the steps of:

printing a main image, which incorporates a hidden image, onto the article;

printing a grating onto the article, so that the hidden image and the grating are in registration, wherein the pitch of the grating is such that the hidden image can be detected.

The packaging portions may be in accordance with any statement herein.

The articles, substrates or packaging portions may be made of, for example, mono-axially orientated polypropylene (MOPP), bi-axially orientated polypropylene (BOPP), polyolefin, or any other polymer film.

Figure 2:
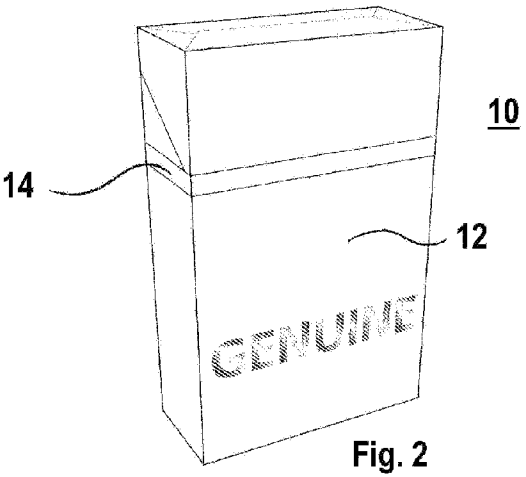
Figure 3:
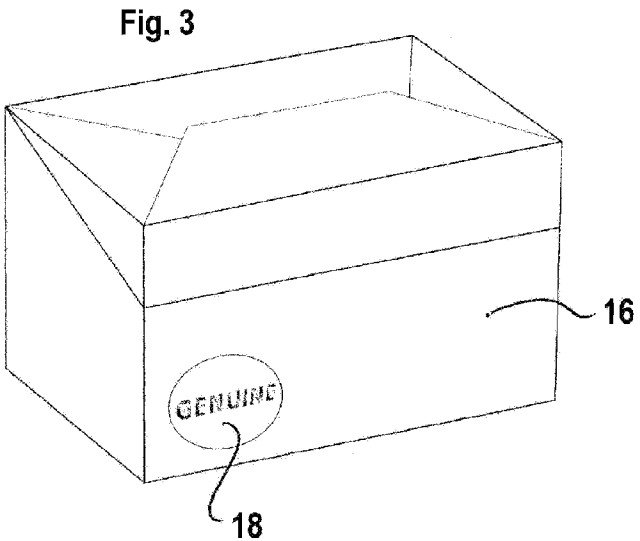
Figure 4:
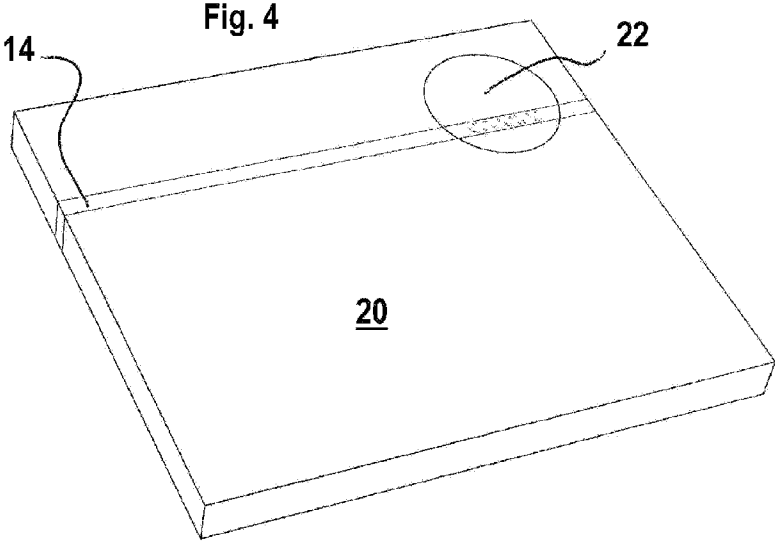
Figure 5:
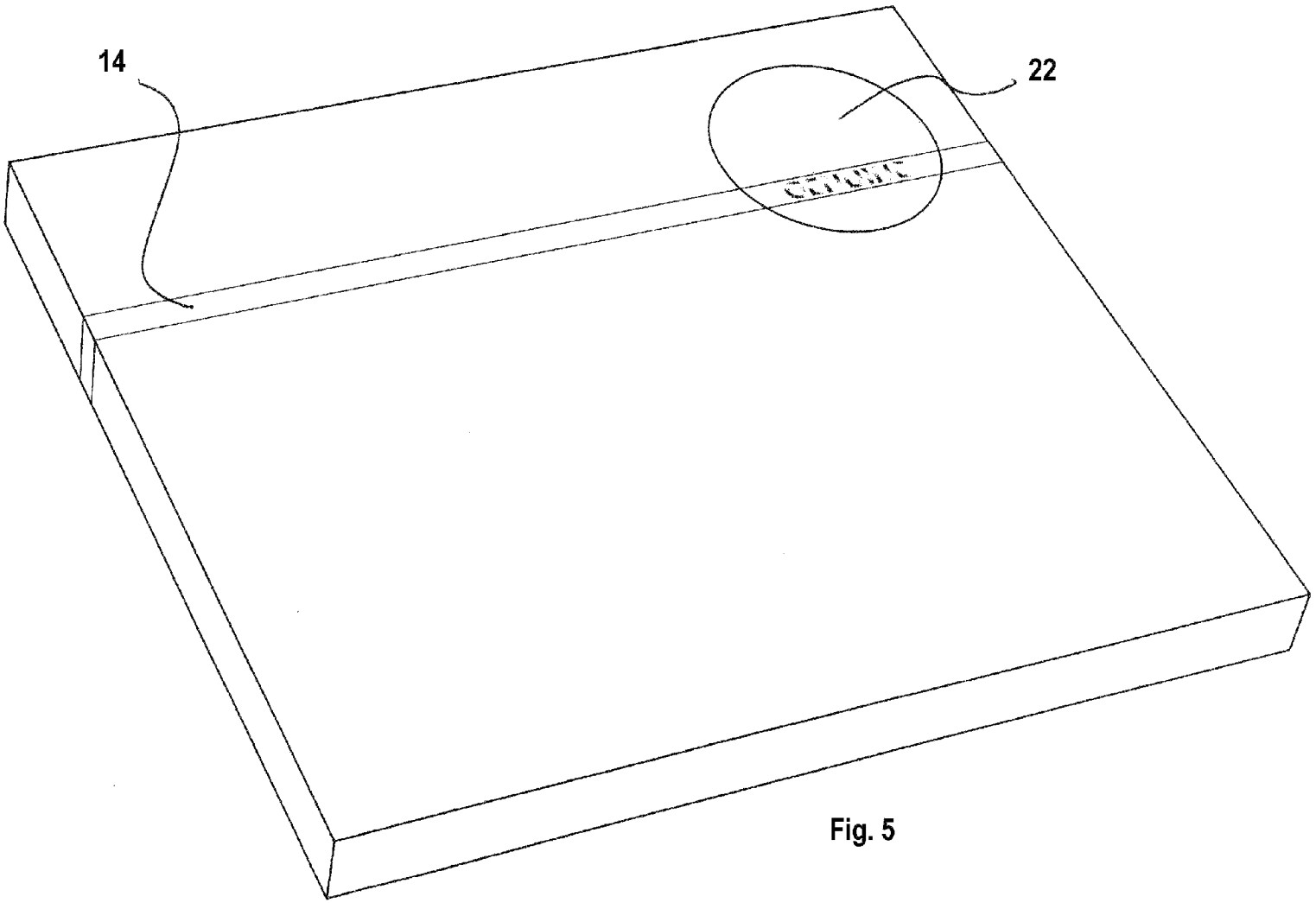

Preferred embodiments of the present invention will now be described, by way of example only, with reference to the accompanying drawings in which:

FIG. 1 shows a packaged article in accordance with a first embodiment of the present invention, FIG. 2 shows a packaged article in accordance with a second embodiment of the present invention, FIG. 3 shows a different packaged article in accordance with a third embodiment of the present invention, FIG. 4 shows a further different packaged article in accordance with a fourth embodiment of the present invention, and FIG. 5 shows the embodiment of FIG. 4 in an alternative condition.

Turning to FIG. 1, this shows a packet of cigarettes, generally at 10. The cigarettes (not shown) are packaged in a conventional cigarette packet, which has been wrapped in a transparent film 12 of bi-axially oriented polypropylene (BOPP) in accordance with a known overwrapping technique. Adhered to the inside of the film 12 is a tear tape 14 for use in removing the film.

The tear tape 14 bears an indicium which is either hidden and becomes visible by viewing the tear tape through the overwrap film 12 or else the appearance of which changes according to the viewing angle when the image is viewed through the film. The image in this case is the word GENUINE. The image on the tear-tape may be scrambled or coded for example by dividing the image into a plurality of elements which may be arranged with respect to each other and/or with respect to a second image in a predetermined manner such as, for example, offsetting elements of the hidden image with respect to a grid or matrix from which a main image is composed. The overwrap film includes a descrambling or decoding region which, when superimposed on the tear tape and in registration therewith, reveals the hidden image, or renders the image visible when viewed through the overwrap portion or creates the visual effect of changing the image according to the viewing angle. The descrambling or decoding region typically comprises a diffraction structure, such as a grating, the characteristics of which, such as its pitch, are complementary with the scrambled or coded image and/or with the pitch of any grid or matrix from which the image is composed.

Alternatively, or in addition, the tear tape may bear a first part of an image and the overwrap film may bear a second, complementary image part, such that when the overwrap film is superimposed on the tape in registration therewith the complete image becomes visible.

In a further alternative, the tear tape, for example, may bear both the first and second image parts. One may be laminated over the over, they may be printed on opposite sides of the tape, or one may be printed directly over the other.

The image(s) and/or descrambling/decoding regions may be applied to the tear tape and film by known printing techniques.

Packaging which bears such sophisticated, yet overt, indicia is difficult to reproduce for the would-be counterfeiter. In particular, the printing techniques are difficult to achieve with the required accuracy, and it is difficult to perform the packaging process with sufficient precision to ensure registration of the packaging portions, without which the image would either be lost completely or else would clearly be below standard.

In FIG. 1, the example of the complementary, "hidden and revealed" packaging portions which must be in registration is that of the tear tape and overwrap film. In FIG. 2, the hidden image is printed directly on the packet containing the cigarettes, and the revealing region of the film overlies the packet in sufficient registration to reveal the image. FIG. 3 is an embodiment in which the hidden image is printed onto the film, which in this case wraps a carton or box 16, and the descrambling or decoding is provided by a label 18 adhered to the outside of the film.

FIG. 4 shows an article, in this case a compact disc 20, which has been overwrapped in film 12 with a tear tape applied to its undersurface. A label 22 overlies the film and tape 14 in less than accurate registration with a hidden image on the tape. The label contains the revealing region. The tape 14 and label 22 are, in this Figure, in less than sufficient registration and so the image is obviously unclear. FIG. 5 shows the same article with the tear tape and label 22 in accurate registration, the image being clearly visible as an indication that the packaged article is genuine.

As stated above, in each case the hidden image could instead simply be a first part of an image and the revealing image region could instead be a second part of an image, the complete image being visible only when there is precise registration of the two packaging portions.

Alternatively, the two parts of the image could be laminated together, or printed on the same piece of packaging, or one part of the image could be printed directly on top of the other. This would avoid registration problems, and would ensure that the composite image could always be seen.

The image can be of any design chosen by the brand owner, and may serve to enhance the brand without necessarily alerting a sensitive customer to the possible presence of fake goods in the market.

Reference to printing herein should be taken to include the imparting of an image to a surface by other techniques such as, for example embossing or etching.

What is claimed is:

1. A method of packaging an article, the method comprising positioning a first packaging portion on said article, said first packaging portion including a security message image printed onto a surface of the first packaging portion, said security message image comprising a plurality of related, separate printed image elements arranged on said surface of the first packaging portion, said security message image visually detectable only when viewed, combined and changed through a separate, select optical device placed in registration with said image elements; and placing an overwrap second packaging portion over the surface of the first packaging portion, the overwrap second packaging portion including said select optical device positioned in registration with said image elements to combine and change the image elements viewed through said select optical device to reveal the security message image.

2. The method of claim 1 including the step of adhering said overwrap second packaging portion to said first packaging portion with said select optical device in registration with said image elements.

3. The method of claim 1 wherein said first packaging portion is in the form a tear strip and said overwrap second packaging portion is in the form of a transparent film.

* * * * *